US005086873A

United States Patent [19]

George

[11] Patent Number: 5,086,873

[45] Date of Patent: Feb. 11, 1992

[54] TREE STEP

[76] Inventor: Peter R. George, 130 Ch Castle Bar, Kingsey Falls, Quebec, Canada, J0A 1B0

[21] Appl. No.: 646,403

[22] Filed: Jan. 28, 1991

[51] Int. Cl.[5] ..... A63B 27/00

[52] U.S. Cl. ..... 182/92; 182/189

[58] Field of Search ..... 182/92, 91, 90, 100, 182/228

[56] References Cited

U.S. PATENT DOCUMENTS

| | | | |
|---|---|---|---|
| 3,283,852 | 11/1966 | Merz | 182/92 |
| 3,598,201 | 8/1971 | Thurmond | 182/92 |
| 3,712,418 | 1/1973 | Currence | 182/92 |
| 4,027,742 | 6/1977 | House | 182/92 |
| 4,249,635 | 2/1981 | West | 182/92 |
| 4,263,983 | 4/1981 | Norton | 182/100 |
| 4,265,333 | 5/1981 | Rowell | 182/92 |
| 4,422,527 | 12/1983 | Schultz | 182/92 |
| 4,618,028 | 10/1986 | Dale | 182/92 |
| 4,620,610 | 11/1986 | Southard | 182/92 |
| 4,674,597 | 6/1987 | Humphrey | 182/92 |

*Primary Examiner*—Reinaldo P. Machado
*Attorney, Agent, or Firm*—Donald J. Breh

[57] ABSTRACT

A tree step including a steel rod bent into a configuration including an elongated central portion and a pair of perpendicularly oriented right triangular shaped portions extending perpendicularly from the central portion with one leg of each right triangular shaped portion being at opposite ends of the central portion and lying in parallel planes forming a pair of spaced apart 90 degree orientated steps.

9 Claims, 1 Drawing Sheet

TREE STEP

BACKGROUND OF THE INVENTION

This invention relates to a device for assisting a person in climbing a tree and in particular to a portable device particularly suited for use by a woodsman or hunter.

It is common for hunters to have a need to scale trees and devices providing assist in ascent of trees have been devised including devices which utilize fasteners which physically invade the tree resulting in damage to the tree and devices having non-invasive fastening means using ropes or chains that encircle the tree to hold a laterally extending member in place for the user to step on.

Typical steps of this latter type, and to which the present invention relates, are disclosed in U.S. Pat. Nos. 4,620,610; 4,618,028; 4,422,527; 4,674,597 and 3,598,201. While effective, all of these prior art devices require separate attachment of individual steps in order to ascend the tree to any significant height. The higher one desires to scale the tree, the more difficult it becomes to attach the individual steps to the tree since the user must balance himself or in some manner hold himself on one of the lower steps in order to fasten progressively higher steps which is not easily accomplished. Further, in most situations, only two steps are typically required to reach the required height on the tree and rather than having to attach individual steps it would be desirable to have a single device which incorporates at least two steps as an integral part of device thereby eliminating the requirement to attach separate steps.

SUMMARY OF THE INVENTION

The present invention provides for a two step tree climbing assist device formed from an elongated steel rod bent into a configuration forming two right triangular shaped portions lying in planes orientated at right angles to each other and having one leg of each right triangular shaped portion that forms the right angle of the respective triangular shaped portion axially aligned along a line of intersection between the planes of the two right triangular shaped portions.

According to the invention, the second legs of the right triangular shaped portions that form the right angles of the respective right triangular shaped portions are spaced apart in parallel planes lying perpendicular to the planes of the right triangular shaped portions at opposite ends of the device and form the two steps of the device.

According to an important feature of the invention, there is provided a pair of support members, each pair being in the form of a pair of diverging protrusions at each opposite end of a central elongated portion of the device that is formed by the aligned legs of the triangular shaped portions. The diverging protrusions extend angularly outwardly and rearwardly from the central portion and are adapted to engage against the trunk of the tree to be scaled.

According to the invention, the device is secured to the tree by way of a rope encircling the tree and the central elongated portion of the device to pull and hold the support members against the tree.

BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
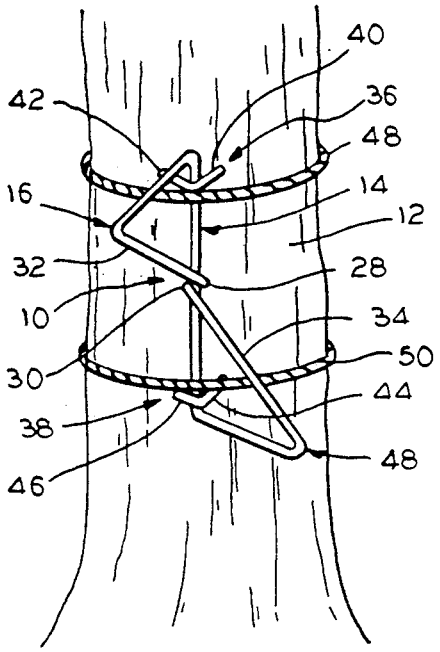
FIG. 1 is a pictorial view of the tree step according to the invention shown attached to the trunk of a tree.
Figure 2:
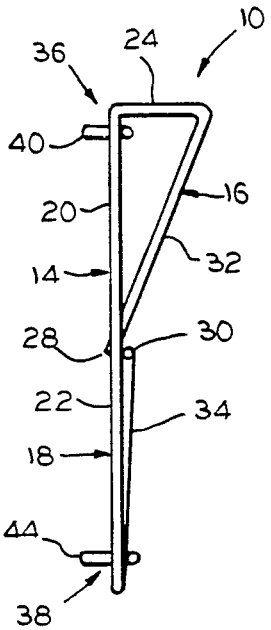
FIG. 2 is a side elevational view as viewed from the left side of the device in FIG. 1 showing details of construction.
Figure 3:
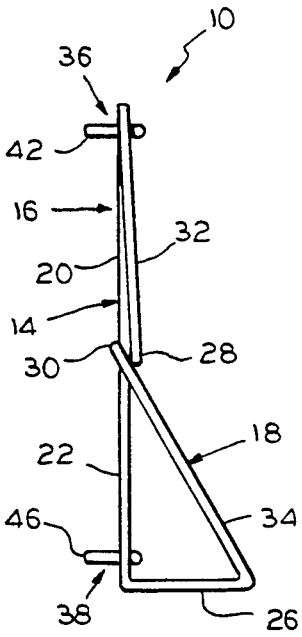
FIG. 3 is a side elevational view of the device according to the invention as viewed from the front side of the plane of the drawing in FIG. 1 showing details of construction.
Figure 4:
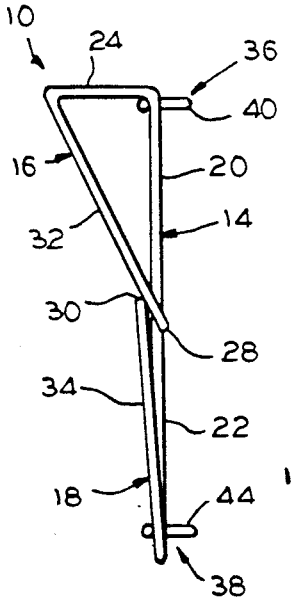
FIG. 4 is a side elevational view of the device according to the invention as viewed from the right side of the device in FIG. 1 showing further details of construction.
Figure 5:
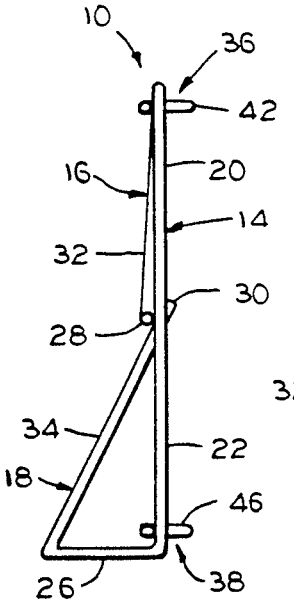
FIG. 5 is a side elevational view of the device according to the invention as viewed from the back side of the plane of the drawing in FIG. 1 showing further details of construction.
Figure 6:
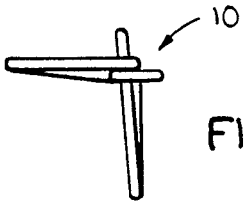
FIG. 6 is a top view of the device in FIG. 1 showing details of construction.
Figure 7:
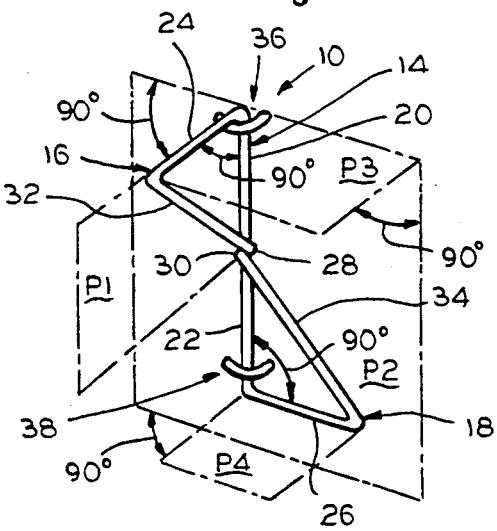
FIG. 7 is an isometric view of the device according to the invention showing the angular orientations of the various portions of the device.

Shown in FIG. 1, is a tree step 10 shown attached to the trunk 12 of a tree to be scaled. The tree step is formed from a length of steel rod of preferably ⅜" diameter which is bent into a configuration including a central elongated portion 14 and a pair of right triangular shaped portions 16, 18. As shown in FIG. 7, the right triangular shaped portions 16, 18 are orientated in perpendicular planes P1, P2 respectively with a central elongated portion 14 being formed by one leg 20, 22 that forms the right angle of each right triangular shaped portion lying on the line of intersection of the two planes P1, P2 of the right triangular shaped portions so that, as shown in the drawings, the legs 20, 22 are accordingly axially aligned. The second legs 24, 26 of each right triangular shaped portion that form the right angle of each right triangular shaped portion are spaced apart in parallel planes P3, P4 lying perpendicular to the planes P1, P2 of the right triangular shaped portions 16, 18 at opposite ends of the central portion 14 and are orientated at 90 degrees relative to each other as viewed toward the top of the device, as shown in FIGS. 6 and 7. The ends 28, 30 of the portions 32, 34 of the rod that form the hypothenuse portion of each right triangular shaped portion are welded to the central portion 14 thereby forming a rigid device wherein the portions 24, 26 are orientated horizontally and form two laterally extending steps when the device is attached to a tree trunk with the central portion vertical as shown in FIG. 1.

As shown in the drawings, a pair of support members 36, 38 are provided each in the form of a pair of diverging protrusions 40, 42; 44, 46 extending angularly outwardly and rearwardly from the central portion 14 proximate each end of the central portion. Each pair of protrusions are angled, for example, at 90 degrees in a common plane which provides for proper receipt against tree trunks of sizes most often scaled. The step is attached to the tree by a pair of ropes 48, 50 tied around the tree and the central portion 14 with the central portion lying vertical.

It has been found that, as noted above, a device constructed of ⅜" steel rod bent into the two right triangular shaped portions orientated as noted and each having vertices of 30 degrees, 60 degrees and 90 degrees with the 30 degree vertices being located at the central portion of the device with the legs which form the steps of the device spaced apart on the order of about 2 feet provides an effective tree climbing assist device having two 6" steps for ascending trees of sizes most often desired to be scaled by a hunter.

Having described the preferred embodiment of the invention, those skilled in the art, having the benefit of the description and the accompanying drawings can readily device other embodiments and modifications which other embodiments and modifications are to be considered to be within the scope of the appended claims.

What is claimed is:

1. A tree step comprising:

an elongated steel rod bent into a pair of right triangular shaped portions meeting at a vertex of each right triangular shaped portion, said right triangular shaped portions lying in perpendicular planes with one leg of each right triangular shaped portion that forms the right angle of each respective right triangular shaped portion lying on a line of intersection between the planes of the two triangular shaped portions, a second leg of each right triangular shaped portion that forms the right angle of each respective right triangular shaped portion lying in parallel spaced apart planes perpendicular to the planes of the pair of right triangular shaped portions; and rope means for securing said one leg of said right triangular portions to the tree.

2. The tree step as defined in claim 1 further including means for supporting said device against a trunk of the tree.

3. The tree step as defined in claim 2 wherein said means for supporting includes two support members at spaced apart locations along the length of said one legs of said triangular shaped portions adapted to engage against said tree trunk.

4. The tree step as defined in claim 3 wherein each of said support members comprises a pair of protrusions diverging outwardly from each of said spaced locations.

5. A tree step comprising:

a steel rod bent into a configuration including an elongated straight central portion and a pair of right triangular shaped portions extending from said central portion in perpendicular planes, said central portion lying on an line of intersection between said perpendicular planes; and rope means for securing said central portion to a trunk of the tree.

6. The tree step as defined in claim 5 further including a pair of support members at spaced apart locations along said central portion.

7. The tree step as defined in claim 6 wherein each support member comprises a pair of co-planer diverging protrusions extending from said central portion.

8. The tree step as defined in claim 7 wherein each support member comprises an angular shaped length of rod affixed to each central portion.

9. A tree step comprising:

a one piece continuous rod-like member bent into a configuration including an elongated central portion, a first step portion extending perpendicularly from said central portion at one end of the central portion and a second step portion extending perpendicularly from said central portion at an end of said central portion opposite said one end and being perpendicular to said first step portion;

support means on said central portion for engaging against a trunk portion of the tree; and means adapted to encircle said trunk portion of the tree to hold said tree support means tightly against said trunk portion.

* * * * *